United States Patent [19]

Klarl

[11] Patent Number: 5,060,449

[45] Date of Patent: Oct. 29, 1991

[54] CONTAINER CLOSING MACHINE HAVING AN IMPROVED AIR FLUSHING SYSTEM

[75] Inventor: Hermann Klarl, Thalmassing, Fed. Rep. of Germany

[73] Assignee: Krones AG Hermann Kronseder Maschinenfabrik, Neutraubling, Fed. Rep. of Germany

[21] Appl. No.: 558,104

[22] Filed: Jul. 26, 1990

[30] Foreign Application Priority Data

Aug. 5, 1989 [DE] Fed. Rep. of Germany ..... 3925952

[51] Int. Cl.[5] ..... B65B 31/00

[52] U.S. Cl. ..... 53/88

[58] Field of Search ..... 53/88, 90, 89, 91, 94, 53/95, 331, 343, 359, 510, 110, 93, 403, 408

[56] References Cited

U.S. PATENT DOCUMENTS

| | | | |
|---|---|---|---|
| 2,620,111 | 12/1952 | Hohl et al. | 53/407 |
| 2,630,957 | 3/1953 | Hohl et al. | 53/432 X |
| 2,652,964 | 9/1953 | Bjering | 53/407 |
| 2,962,060 | 5/1960 | Harmon et al. | 53/510 X |
| 2,968,900 | 1/1961 | Bjering | 53/510 |
| 4,835,937 | 6/1989 | Meyer et al. | 53/88 |

FOREIGN PATENT DOCUMENTS 3515334 10/1986 Fed. Rep. of Germany .

*Primary Examiner*—Robert L. Spruill
*Assistant Examiner*—Daniel B. Moon
*Attorney, Agent, or Firm*—Fuller, Ryan & Hohenfeldt

[57] ABSTRACT

A container closing machine which includes bottle capping devices 2 that are raised and lowered, a starwheel 12 that revolves together with the capping devices and centers the containers, there is a stationary air flushing device 1 which is supplied with non-oxidizing gas and is arranged on the outside of the orbital path followed by bottles as they are held in the pockets of the starwheel. The flushing device 1 has a lateral jet opening 3 opposite of the orbital path of the bottles and at a small clearance with respect to the starwheel in which the open mouths of the bottles extend. Flow chambers conduct the gas emitted from the discharge jet of the flushing device directly past a plurality of the bottle mouths and then radially inwardly to the atmosphere.

5 Claims, 1 Drawing Sheet

Fig. 2
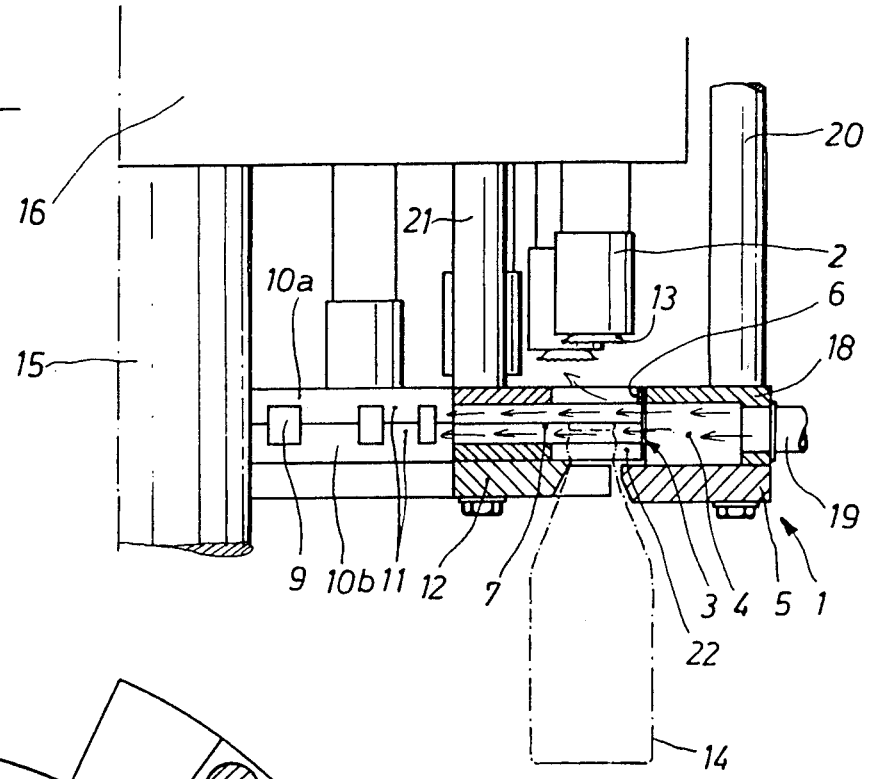
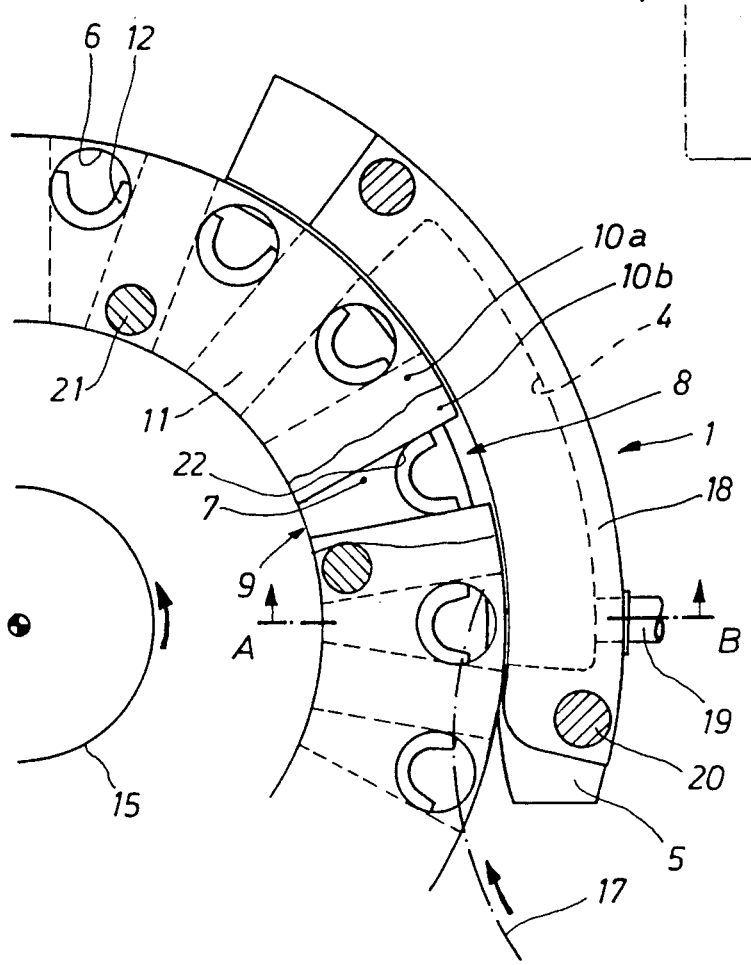
Fig. 1

CONTAINER CLOSING MACHINE HAVING AN IMPROVED AIR FLUSHING SYSTEM

BACKGROUND OF THE INVENTION

The invention disclosed herein pertains to an improved system for flushing the air with an inert gas such as carbon dioxide from the space around the mouth of a container, such as a bottle or a can, as the container is transported through a container closing machine.

German laid open application DE OS 35 15 334 describes a container closing machine wherein each closing device which applies a cap to a bottle is adjacent an individual jet or nozzle that orbits with the closing or capping devices. The relatively narrow jets are arranged within the circular path of the orbiting closing or capping devices such that the jet openings project an inert gas stream radially outwardly to sweep only over the container which is centered below the associated closing device. This arrangement establishes an air or oxygen free atmosphere in the vicinity of the bottle mouth before the sealing cap is applied to the bottle. This known system consumes a relatively small quantity of inert gas and is successful in preventing the entry of atmospheric oxygen into the container being filled. The arrangement has several disadvantages including the need for a number of supply lines for supplying the inert gas to the jets which lines orbit with the orbiting jets. Each jet also requires a rotary or sliding valve that is difficult to position radially inwardly of the circle defined by the orbiting bottle cap applying devices. A further complication results from the need for having a plurality of hoses running to the slide valves through which the gas is fed to the jets. It is known that this arrangement has significant operating problems resulting from the air flushing devices all lying radially inwardly of the circular path followed by the orbiting bottle closing devices. Thus, the parts of the system are accessible only with substantial difficulty and inconvenience.

The invention disclosed herein simplifies construction of the air flushing system of a container closing machine, thereby increasing its reliability.

SUMMARY OF THE INVENTION

Basically, the invention provides for using only one stationary jet for projecting inert gas about the mouths or openings of bottles or cans in a container closing machine. The stationary jet directs the inert gas stream radially inwardly of the circular path followed by the orbiting bottles as they are transported along with the capping or closing devices. Thus, by elongating the jet opening as a segment of a circle positioned radially outwardly of the series of bottles to be capped in the vicinity of the mouths of the bottles, more than one bottle mouth at a time is purged or flushed of atmospheric air by the inert gas stream from the jet. The arrangement is such that no rotary contact or sliding valves are required to feed inert gas to the plenum or stationary chamber which has the jet formed in it. As a result of the relatively wide and long curved design of the jet opening, a substantially total expulsion of air in the vicinity of the container mouth is achieved, particularly with containers having relatively small mouths such as beverage bottles. It is also within the concept of the invention to not only use a long circumferentially extending jet opening but also to divide the jet into short openings which, nevertheless, direct inert gas at the vicinity of several bottle mouths at the same time. Moreover, a number of jets can be connected in succession. This fulfills the basic concept which is to provide a constantly flowing stream of inert gas which sweeps over several container mouths at the same time.

It has been found that even though the inert gas is directed radially inwardly of the bottles as they orbit past the jet on a starwheel at a substantial velocity, there is a totally adequate flushing effect even though the jet stream is directed in opposition to the centrifugal force which acts on the jet stream as a result of the starwheel rotating at high speed like a fan.

The invention also features providing an annular chamber at the level of the container mouths radially inwardly from the mouths to enhance exclusion of air from the vicinity of the mouths. This annular chamber which is implemented by using the upper side of a starwheel which is used for container transport and a disk or plate arranged on top of it at a distance so as to allow for the inert gas from the jet opening to be led directly along a radially inward path to the level of the space between the mouth of the container and the closing devices.

An important feature of the invention is that it permits optimal air flushing with the least gas consumption as a result of using flow chambers that lead the gas from the jet opening past the container mouth at the exact height and lateral position of the container mouths.

How the foregoing objectives and other novel features of the invention are achieved and implemented, will appear in the ensuing description of a more detailed embodiment of the invention in reference to the drawing.

DESCRIPTION OF THE DRAWING

FIG. 1 is a partial top or plan view of a container closing machine taken at the level of the container transporting starwheel and the jet system for projecting inert gas; and FIG. 2 is a partial vertical sectional view of the container closing machine taken on a line corresponding to A-B in FIG. 1.

DESCRIPTION OF A PREFERRED EMBODIMENT

The container closing machine shown in FIGS. 1 and 2 is for applying crown caps 13 onto bottles 14 which are filled with a liquid. The machine has a center column 15 which rotates in the direction of the arrow applied next to it. In the actual machine, there is a rotating table, not shown, that supports the bottles 14 at their bottoms and there is a rotor 16 spaced at some distance above it. The rotor 16 supports a number of bottle capping or closing devices 2 that are raised and lowered in a well known manner by means of cams, not shown.

A bottle transport or bottle neck stabilizing device in the form of a starwheel 12 having essentially semi-circular pockets revolves with rotor 16. As can be seen best in FIG. 1, there is a guide member 5 having a contoured leading end for guiding bottles into the pocket of starwheel 12. FIG. 1 shows how guide member 5 is curved and extends along the circular path along which the bottles move. The bottles are on a rotating table, not shown, and are conducted to the starwheel along the path of the dash-dot line 17 in FIG. 1.

The curved guide member 5 holds the bottles in the pockets of starwheel 12 as the bottles are transported orbitally. Bottles 14 which are to be capped are assumed to be filled with a beverage that is sensitive to oxygen. The bottles have passed through a filling machine, not shown, before they are fed to starwheel 12 along path 17.

The new air flushing system includes the inert gas jet assembly 1 which is arranged stationarily at the level of the bottle mouths for the purpose of flushing the region above the bottle mouths and under the crown caps 13 with the inert or non-oxidizing gas such as carbon dioxide. Jet assembly 1 comprises a curved block 18 which is concentric to center column 15. Block 18 contains a concentric plenum or channel 4. This channel is bounded radially outwardly and upwardly by the wall of curved block 18 and at its bottom by the curved guide member 5. Channel 4 is open on its radially inward side such as to define a longitudinally extending slot or jet opening 3. Jet opening 3 is faced toward the center of the orbital path of the bottles 14. The inert gas that flows out of the jet opening 3 is supplied by a gas input means formed by stationary tube 19 which connects to channel 4 so that inert gas fills the channel under a sufficient pressure head for a gas stream to be projected out of jet opening 3 to flush the air out of the region above the bottle mouth and beneath crown cap 13. The curved guide member 5 which closes the bottom of the channel 4 is sealingly fastened to block 18 by means of several screws and is fastened to the stationary lid, not shown, of the rotor 16 by means of rods 20. When rotor 16 is moved vertically, the exact position of air flushing device 1 and the jet 3 thereof and the bottle capping devices 2 is automatically maintained.

Two circular plate members 10*a* and 10*b* are fastened concentrically to the rotational axis of rotor 16 on the underside of the rotor by means of several posts 21 and machine screws at the level of the container mouths and at the same level as jet block 18. Starwheel 12 is also clamped against the underside of the lower disk 10 by means of the screws. Plate members 10*a* and 10*b* are smooth and even on their outer edges but are provided with radially inwardly directed ribs or projections 11. One half of each projection is formed on plate member 10*a* and the other half is formed on plate member 10*b* and the halves are arranged congruently to form single circumferentially spaced apart radially projecting dividers 11. The dividers 11 extend radially toward the rotational axis or rotor 16 between each two adjacent pockets in the starwheel 12.

The free spaces that remain between dividers 11 extend substantially radially toward the rotational axis or rotor 16 and constitute exhaust channels or flow passageways 7 bounded by upper and lower plate members 10*a* and 10*b*. Since the radial outward edges of plate members 10*a* and 10*b* project to some degree beyond the bottle toward the outside, the head ends of the bottles are completely embraced in the passageways 7. To avoid hindering entry of the bottles 14 into starwheel 12 along dash-dot line 17, the lower plate member 10*b* which is positioned at the level of the head end of the bottle is provided with recesses 22 in the area of the semi-circular starwheel pockets. The upper plate member 10*a* which is in a position approximately over the mouth of the bottle is provided with holes 6 through which the closing devices 2 with the magnetically held caps 13 on the underside can descend into the flow passageways 7, whereby they seal or close the hole 6 through which they enter the chamber such that the inert gas is prevented from leaking through hole 6 and is thus, minimally if at all, diluted with air. The flow passageways 7 are also almost completely sealed off on their lower sides by means of starwheel 12, the head of the bottle that is held inside of the starwheel and also by the curved guide member 5.

The radial outward and inward edges of plate members 10*a* and 10*b* lie on an imaginary cylinder arranged concentric to rotor 16. The intersection of the flow passageways 7 with the outer cylindrical surfaces of the plate members 10*a* and 10*b* thereby form an inlet opening 8 for inert gas and the intersection with the inner cylindrical edge surfaces of the plate members forms an outlet 9 for the inert gas discharge from jet opening 3. As shown in FIG. 1, the size of the flow passageways 7 converge or taper radially inwardly as they are directed radially inwardly such that the outlet 9 has a smaller cross-section than the inlet 8. This convergence or narrowing of flow passageways 7 causes some back pressure to be developed so that inert gas consumption is decreased from what it might otherwise have been if the gas flow passageways 7 did not have an outlet 9 which is smaller than inlet 8. This accounts for the flow passageways 7 being longer in the radial direction than they would have to be if the exclusive purpose of the starwheel 12 were to only allow capturing of the bottles in the starwheel pockets between these pockets and the guide member 5.

As can readily be seen in FIGS. 1 and 2, the outer circular edge having the inlet opening 8 for the inert gas passes the concentric curved jet opening 3 of jet assembly 1 with small clearance. The open side 3 of channel 4 in the plenum or chamber 1 is arranged for supplying three inlets 8 with a stream of carbon dioxide. Inert gas losses are therefore very small and the air flushing effect is correspondingly high even with starwheels that operate at high circular velocity, there is assurance that the flow passageways 7 and the surrounding of the container mouth will not contain any atmospheric oxygen when they arrive at the end of channel 4 and the end of jet opening 3 considering the direction of rotation of starwheel 12. It is when the bottle arrives at the most counterclockwise end of the channel 4 in FIG. 1 that the crown caps 13 are pressed onto the mouth of bottles. The inert gas which flushes the air from around the bottle mouth and out of flow passageways 7 flows through outlets 9 together with the air that is entrained and flows into the atmosphere.

I claim:

1. A container closing machine comprising:

a rotationally driven rotor and a container closing device carried on said rotor for being moved along a circular path, wheel means which rotates with the rotor and centers the mouths of said containers under said container closing device while said containers move along said circular path, a system for flushing atmospheric air from the vicinity of the mouth of said container with gas before said container is closed, said system comprising fixedly positioned means for defining a channel having input means for gas, said channel being arranged radially outwardly of said circular path of the mouths of the said containers and having at least one gas jet outlet positioned radially outwardly of said circular path and arranged for projecting a stream of gas radially inwardly over the mouths of a plurality of containers simultaneously, said wheel means including upper and lower vertically spaced apart plate members revolving with said closing devices and defining a gas conducting passageway between them generally coplanar with said gas jet outlet of said channel, said upper member having openings through which said closing devices move towards said bottle mouths for closing said containers, said passageway having an inlet which rotates past the jet outlet of said means for defining a channel with small clearance.

2. The container closing machine according to claim 1 wherein said lower of the vertically spaced apart plate members has radially outwardly presented pockets in which the part of said containers adjacent their mouths are engaged, and a guide member included in said means for defining a channel and constituting the bottom of said channel, said guide member having a curved surface extending along said circular path radially outwardly thereof and concentric therewith contiguous to a plurality of said pockets for securing said bottles in said pockets.

3. The container closing machine according to claim 1 including circumferentially spaced apart divider members arranged in said passageway for dividing said passageway into a plurality of subpassageways in which the mouths of individual containers are disposed, said passageway having an inlet opening contiguous with the outlet of said channel and having an outlet radially inwardly of said wheel from said inlet.

4. The container closing machine according to claim 3 wherein said divider members are disposed in said passageway of said wheel means coincident with circumferentially spaced apart radii of said wheel means and the subpassageways, respectively, defined by said divider members are tapered from a circumferentially wide space more radially outwardly of said wheel means to a circumferentially narrower space more radially inwardly of said wheel means.

5. The container closing machine according to claim 3 wherein said subpassageways have an inlet opening contiguous with said outlet of said means for defining a channel and an outlet opening more radially inwardly of said wheel means from said inlet opening and said inlet opening has a larger area than said outlet opening.

* * * * *